US007415123B2

(12) United States Patent
Ballas

(10) Patent No.: US 7,415,123 B2
(45) Date of Patent: Aug. 19, 2008

(54) METHOD AND APPARATUS FOR PRODUCING SPATIALIZED AUDIO SIGNALS

(75) Inventor: James A Ballas, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 550 days.

(21) Appl. No.: 11/264,346

(22) Filed: Oct. 31, 2005

(65) Prior Publication Data

US 2006/0056639 A1 Mar. 16, 2006

Related U.S. Application Data

(63) Continuation-in-part of application No. 09/962,158, filed on Sep. 26, 2001, now Pat. No. 6,961,439.

(51) Int. Cl.
*H04R 5/02* (2006.01)

(52) U.S. Cl. ..... 381/309; 381/310; 381/17

(58) Field of Classification Search ..... 381/309, 381/310, 17–23, 1, 26, 74
See application file for complete search history.

(56) References Cited

U.S. PATENT DOCUMENTS 3,962,543 A 6/1976 Blauert et al.
5,146,501 A 9/1992 Spector
5,272,757 A 12/1993 Scofield et al.
5,438,623 A 8/1995 Begault
5,459,790 A 10/1995 Scofield et al.
5,633,993 A 5/1997 Redmann
5,661,812 A 8/1997 Scofield et al.
5,680,465 A 10/1997 Boyden
5,815,579 A 9/1998 Boyden
5,841,879 A 11/1998 Scofield et al.
5,881,390 A 3/1999 Young
5,943,427 A 8/1999 Massie et al.
5,953,434 A 9/1999 Boyden
6,021,206 A 2/2000 McGrath (Continued)

OTHER PUBLICATIONS

Chong-Jin Tan et al., "Direct Concha Excitation For The Introduction Of Individualized Hearing Cues," *Jounal of Audio Engineering Society*, Vo. 48, Nol. 7/8; Jul.-Aug., 2000.

*Primary Examiner*—Xu Mei
(74) *Attorney, Agent, or Firm*—John J. Karasek; Thomas D. Robbins

(57) ABSTRACT

A method and apparatus for producing virtual sound sources that are externally perceived and positioned at any orientation in azimuth and elevation from a listener is described. In this system, a set of speakers is mounted in a location near the temple of a listener's head. A head tracking system determines the location and orientation of the listeners head and provides the measurements to a computer which processes audio signals, from an audio source, in conjunction with a head related transfer function (HRTF) filter to produce spatialized audio. The HRTF filter maintains the virtual location of the audio signals/sound, thus allowing the listener to change locations and head orientation without degradation of the audio signal. The audio system of the present invention produces virtual sound sources that are externally perceived and positioned at any desired orientation in azimuth and elevation from the user.

9 Claims, 6 Drawing Sheets

U.S. PATENT DOCUMENTS

| | | | | |
|---|---|---|---|---|
| 6,038,330 | A | 3/2000 | Meucci, Jr. | |
| 6,144,747 | A | 11/2000 | Scofield | |
| 6,259,795 | B1 | 7/2001 | McGrath | |
| 6,370,256 | B1 | 4/2002 | McGrath | |
| 6,718,042 | B1 * | 4/2004 | McGrath | 381/310 |
| 7,333,622 | B2 * | 2/2008 | Algazi et al. | 381/310 |

* cited by examiner

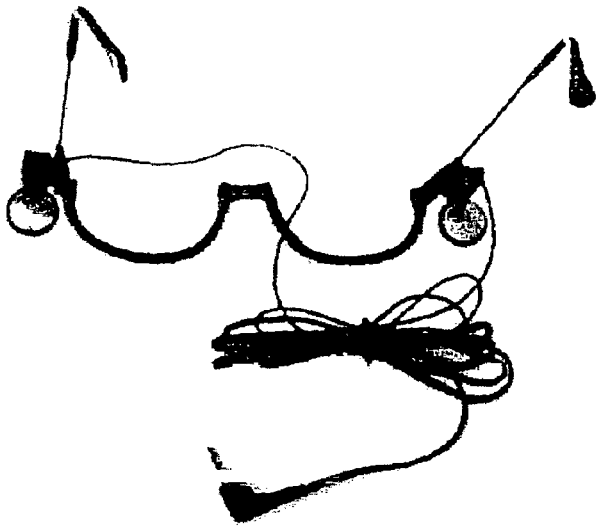
Figure 3. Eyeglass frame mount prototype
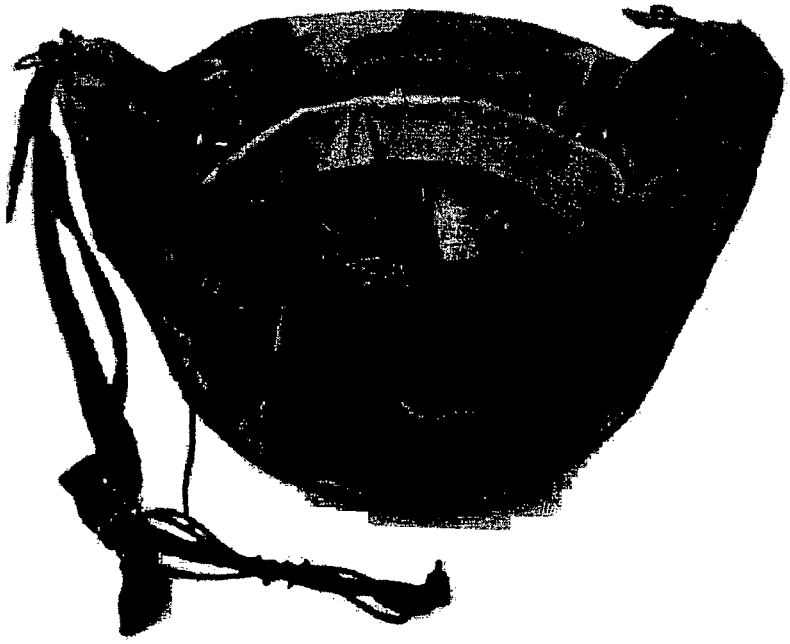
Figure 4. Helmet mount prototype

METHOD AND APPARATUS FOR PRODUCING SPATIALIZED AUDIO SIGNALS

CROSS-REFERENCE TO RELATED APPLICATIONS

This Application is a Continuation-in-part of application Ser. No. 09/962,158 filed on Sep. 26, 2001 now U.S. Pat. No. 6,961,439.

FIELD OF THE INVENTION

This invention relates to audio systems. More particularly, it relates to a system and method for producing spatialized audio signals that are externally perceived and positioned at any orientation and elevation from a listener.

BACKGROUND AND SUMMARY OF THE INVENTION

Spatialized audio is sound that is processed to give the listener an impression of a sound source within a three-dimensional environment. A more realistic experience is observed when listening to spatialized sound than stereo because stereo only varies across one axis, usually the x (horizontal) axis.

In the past, binaural sound from headphones was the most common approach to spatialization. The use of headphones takes advantage of the lack of crosstalk and a fixed position between sound source (the speaker driver) and the ear. Gradually, these factors are endowed upon conventional loudspeakers through more sophisticated digital signal processing. The wave of multimedia computer content and equipment has increased the use of stereo speakers in conjunction with microcomputers. Additionally, complex audio signal processing equipment, and the current consumer excitement surrounding the computer market, increases the awareness and desire for quality audio content. Two speakers, one on either side of a personal computer, carry the particular advantage of having the listener sitting rather closely and in an equidistant position between the speakers. The listener is probably also sitting down, therefore moving infrequently. This typical multimedia configuration probably comes as close to binaural sound using headphones as can be expected from free field speakers, increasing the probability of success for future spatialization systems.

Spatial audio can be useful whenever a listener is presented with multiple auditory streams. Spatial audio requires information about the positions of all events that need to be audible, including those outside of the field of vision, or that would benefit from increased immersion in an environment. Possible applications of spatial audio processing techniques include: military communication systems to and between individuals within military vehicles, ships and aircraft as well as to and between dismounted soldiers; complex supervisory control system such as telecommunications and air traffic control systems; civil and military aircraft warning systems; teleconferencing and telepresence applications; virtual and augmented reality environments; computer-user interfaces and auditory displays, especially those intended for use by the visually impaired; personal information and guidance systems such as those used to provide exhibit information to visitors in a museum; and arts and entertainment, especially video games and music, to name but a few.

Environmental cues, such as early echoes and dense reverberation, are important for a realistic listening experience and are known to improve localization and externalization of audio sources. However, the cost of exact environmental modeling is extraordinarily high. Moreover, existing spatial audio systems are designed for use via headphones. This requirement may result in certain limitations on their use. For example, spatial audio may be limited to those applications for which a user is already wearing some sort of headgear, or for which the advantages of spatial sound outweigh the inconvenience of a headset.

U.S. Pat. No. 5,272,757, 5,459,790, 5,661,812, and 5,841,879, all to Scofield disclose head mounted surround sound systems. However, none of the Scofield systems appear to use head related transfer function (HRTF) filtering to produce spatialized audio signals. Furthermore, Scofield uses a system that converts signals from a multiple surround speaker system to a pair of signals for two speakers. This system appears to fail a real-time spatialization system where a person's head position varies in orientation and azimuth, thus requiring adjustment in filtering in order to maintain appropriate spatial locations.

One current method for generating spatialized audio is to use multiple speaker panning. This method only works for listeners positioned at a sweet spot within the speaker array. This method cannot be used for mobile applications. Another method, often used with headphones, requires complex individual filters or synthesized sound reflections. This method performs filtering of a monaural source with a pair of filters defined by a pair of head related transfer functions (HRTFs) for a particular location. Each of these methods has limitations and disadvantages. The latter method works best if individual filters are used, but the procedure to produce individual filters is complex. Further, if individual filters or synthesized sound reflections are not used, then front-back confusions and poor externalization of the sound source would result. Thus, there is a need to overcome the above-identified problems.

BRIEF SUMMARY

Accordingly, the present invention provides a solution to overcome the above problems. In the present invention, a pair of speakers is mounted in a location near the temple of a listener's head, such for example, on an eyeglass frame or inside a helmet, rather than in headphones. A head tracking system also mounted on the frame where speakers are mounted determines the location and orientation of the listener's head and provides the measurements to a computer system for audio signal processing in conjunction with a head related transfer function (HRTF) filter to produce spatialized audio. The HRTF filter maintains virtual location of the audio signals, thus allowing the listener to change locations and head orientation without degradation of the audio signal. The system of the present invention produces virtual sound sources that are externally perceived and positioned at any desired orientation in azimuth and elevation from the listener.

In its broader aspects, the present invention provides an apparatus for producing spatialized audio, the apparatus comprising at least one pair of speakers positioned near a user's temple for generating spatialized audio signals, whereby the speakers are positioned coaxially with a user's ear regardless of the user's head movement; a tracking system for tracking the user's head orientation and location; a head related transfer function (HRTF) filter for maintaining virtual location of the audio signals thereby allowing the user to change location and head orientation without degradation of the virtual location of audio signals; and a processor for receiving signals from the tracking system and causing the filter to generate spatialized audio, wherein the speakers are positioned to generate frontal positioning cues to augment spatial filtering for virtual frontal sources without degrading spatial filtering for other virtual positions.

In another aspect, a method of producing spatialized audio signals, the method comprising: positioning at least one pair of speakers near a user's temple for generating spatialized audio signals, whereby the speakers are positioned coaxially with a user's ear regardless of the user's head movement to generate frontal positioning cues to augment spatial filtering for virtual frontal sources without degrading spatial filtering for other virtual positions; tracking orientation and location of the user's head using a tracking system; maintaining virtual location of the audio signals using a head related transfer function (HRTF) filter; and processing signals received from the tracking system using a processor; and controlling the filter using the processor to generate spatialized audio signals.

In a further aspect, the present invention provides a system for producing spatialized audio signals, the system comprising: means for positioning at least one pair of speakers near a user's temple for generating spatialized audio signals, whereby the speakers are positioned coaxially with a user's ear regardless of the user's head movement; a tracking means for tracking orientation and location of the user's head; a filtering means for maintaining virtual location of the audio signals; and means for processing signals received from the tracking means; and means for controlling the filter means to generate spatialized audio signals.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF SUMMARY OF THE DRAWINGS

The accompanying drawings, which are incorporated in and form a part of the specification, illustrate an exemplary embodiment of the present invention and, together with the description, serve to explain the principles of the invention. It is noted that the exemplary embodiment is drawn to iris recognition. However novel aspects of the present invention are not limited in this scope. On the contrary, the novel aspects of the present invention can additionally be drawn to retina recognition or recognition of any parameter that can be imaged. In the drawings:

FIGS. 3-4 illustrate various methods of mounting the speakers as shown in FIGS. 1-2;

DETAILED DESCRIPTION

Figure 1:
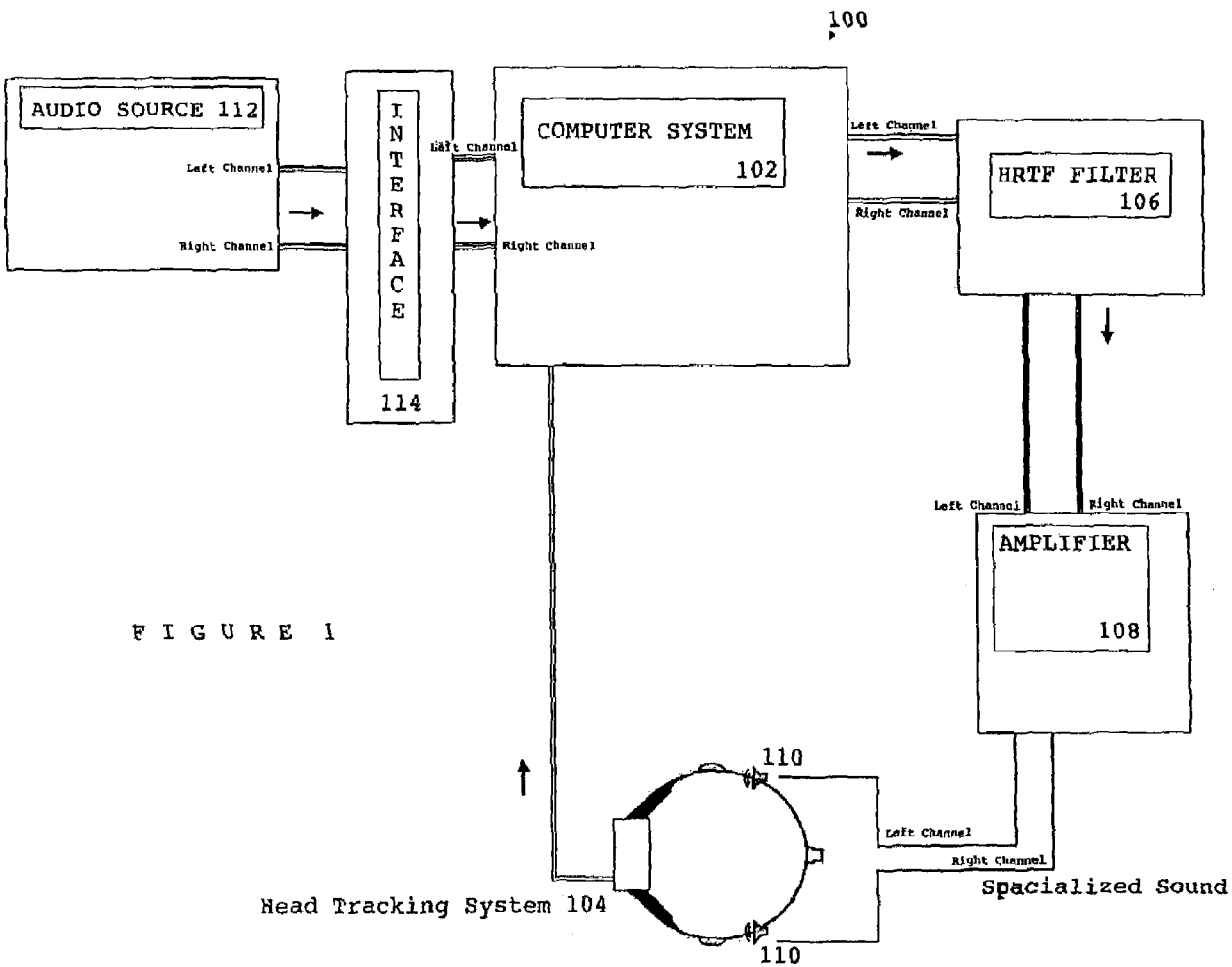
FIG. 1 illustrates an exemplary system configuration of the present invention.

FIG. 1 shows an exemplary audio system configuration of the present invention as generally indicated at 100. Audio system 100 includes a computer system 102 for controlling various components of system 100. Audio signals from an audio source, such as for example, an audio server 112 are received by computer system 102 for further processing. Computer system 102 is an "off the shelf" commercially available system and could be selected from any of the following systems, which have been used to implement this invention: the Crystal River Engineering Acoustetron II; the Hewlett Packard Omnibook with a Crystal PnP audio system and RSC 3d audio software; an Apple Cube with USB stereo output and 3D audio software.

A head tracking system 104 is mounted on a frame to which speakers 110 are attached close to the temple of a user's head. The frame is mounted on the user's head and moves as the head moves. Any conventional means for attaching the speakers to the frame may be used, such as for example, using fasteners, adhesive tape, adhesives, or the like. Head tracking system 104 measures the location and orientation of a user's head and provides the measured information to computer system 102 which processes the audio signals using a head related transfer function (HRTF) filter 106 thus producing spatialized audio. The spatialized audio signals are amplified in an amplifier 108 and fed to speakers 110. The amplified signals are binaural in nature (i.e., left channel signals are supplied to the left ear and right channel signals are supplied to the right ear. Amplifier 108 generates sound that is loud enough to be heard in the nearest ear but generally too soft to be heard in the opposite ear. Speakers 110 are mounted, for example, to an eyeglass frame or appropriately mounted to the inside of a helmet as shown in FIGS. 3 and 4. The speakers may also be mounted on a virtual reality head mounted visual display system. A miniature amphitheater-shell may be added to the mounting frame in order to increase the efficiency of the speakers.

In operation, location and orientation information measured by head tracking system 104 is forwarded to computer system 102 which then processes the audio signals, received from an audio server, using head related transfer function filter 106 to produce a spatialized audio signals. The spatialized audio signals are amplified in amplifier 108 and then fed to speakers 110. The source of the sound is kept on axis with user's ear regardless of the head movement, thus simplifying the spatialization computation.

Figure 2:
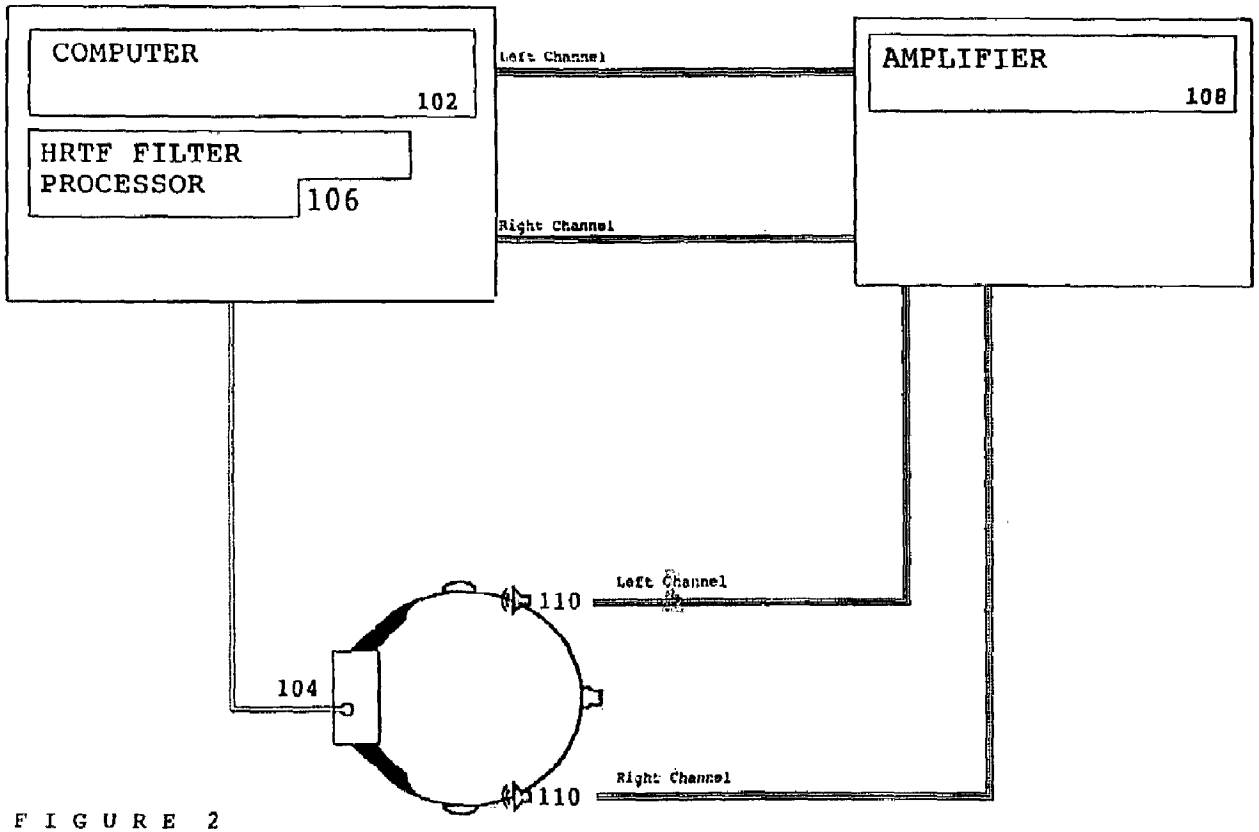
FIG. 2 illustrates another embodiment of the present invention as shown in FIG. 1.

FIG. 2 shows another embodiment of the present invention as in FIG. 1. Here, processor 102 also performs the HRTF filtering functions. The audio source is generated and operates under the control of the computer system. The rest of the operation of FIG. 2 is similar to the operation as explained with respect to FIG. 1.

One aspect of the present invention, as alluded to above, deals with the manner in which the speakers are positioned in front of the ears of the user. For example, an apparatus may be used with a system that produces spatialized audio signals, wherein the apparatus includes a headpiece, speakers and an input system. The input system provides the spatially filtered audio signals from the HRTF filter to the speakers. Non-limiting examples of an input system include wires and wireless transmission systems. The speakers reproduce the sound from the spatially filtered audio signals such that the person hears the sound and perceives a maintained virtual location of the source of the sound. Further, the speakers are disposed with the headpiece so as to be positioned to augment the sound such that the perceived front-to-back reversals in a maintained virtual location of the source of the sound are reduced.

Figure 5:
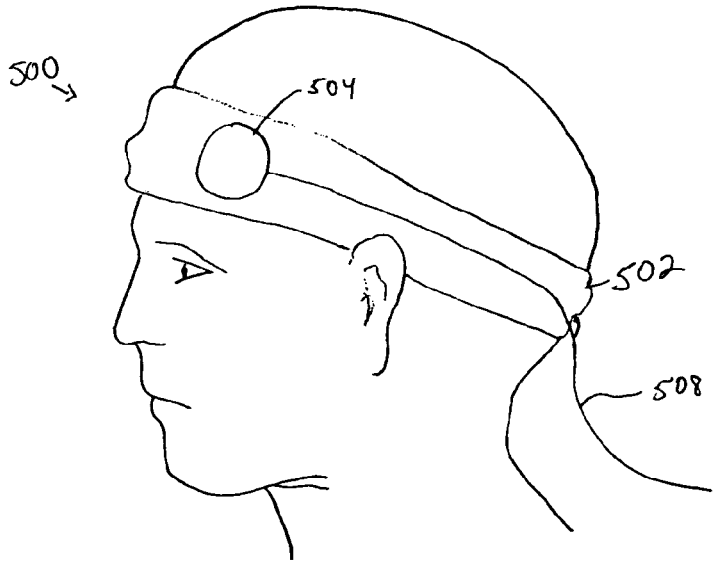
FIG. 5 illustrates a side view of an exemplary embodiment of a headpiece in accordance with the present invention.
Figure 6:
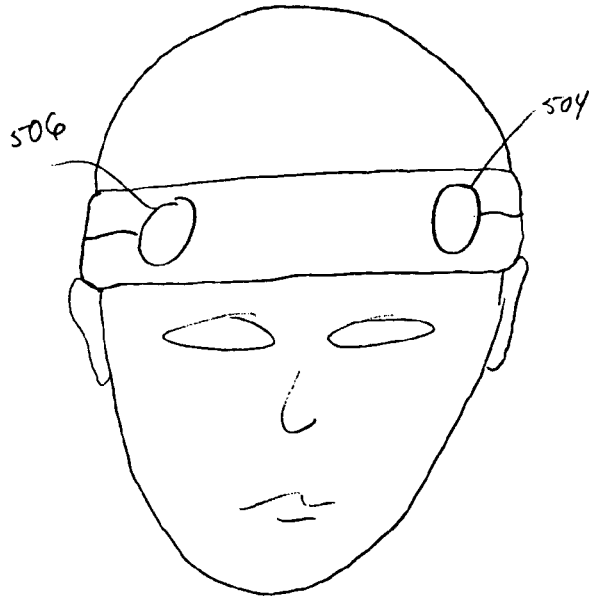
FIG. 6 illustrates a front view of the headpiece in FIG. 5.

In apparatus 500, as one exemplary embodiment illustrated in FIGS. 5 and 6, the headpiece is a headband 502, the speakers are speakers 504 and 506 and the input system is wire 508. Other non-limiting examples of a headpiece in accordance with the present invention include a hat, helmet, or any other article that can position the speakers to augment the sound such that the user's perceived front-to-back reversals are reduced. Further, other non-limiting examples of a number, size and shape of speakers in accordance with the present invention include those that can reproduce the sound to the user based on the spatially filtered audio signals from the HRTF. Further, the speakers may be water retardant so as to resist corruption by rain or sweat.

Figure 7:
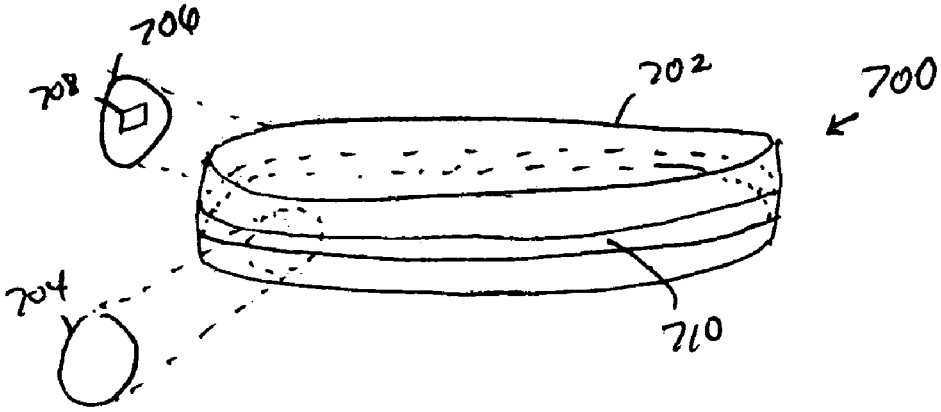
FIG. 7 illustrates an embodiment of a headband in accordance with the present invention.

FIG. 7 illustrates an embodiment of a headband in accordance with the present invention. As depicted in the figure, headband 700 includes a wearable portion 702 and an attachment strip 710. Attachment strip 710 enables speakers 704 and 706 to be attached thereto via an attachment portion, e.g., item 708 as depicted on speaker 706. Attachment strip 710 and attachment portion 708 may be a hook and loop system, such as provided by Velcro®. Accordingly, the positions of speakers 704 and 706 may be changed to minimize the front-to-back reversals. Other attachment mechanisms, which enable speakers to be disposed with the headpiece so as to be positioned to augment the sound such that the perceived front-to-back reversals in a maintained virtual location of the source of the sound are reduced, may be used in accordance with the present invention. Such attachment mechanisms may be permanent, such as by an adhesive, wire, thread, etc., or detachable, such as with a clip or button.

Figure 8:
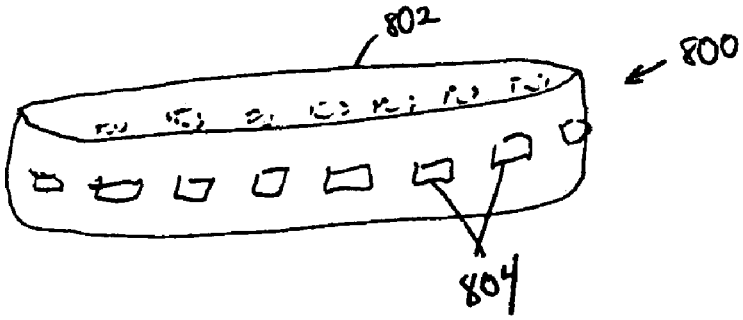
FIG. 8 illustrates another embodiment of a headband in accordance with the present invention.

FIG. 8 illustrates another embodiment of a headpiece in accordance with the present invention. As depicted in the figure, headband 800 includes a wearable portion 802, and a plurality of attachment areas 804. Attachment areas 804 enables speakers 704 and 706 to be attached thereto via attachment portion 708. Attachment areas 804 and attachment portion 708 may be a hook and loop system, such as provided by Velcro®. Accordingly, the positions of speakers 704 and 706 may be changed to minimize the front-to-back reversals. The number of attachment areas 804 is not limited. For example, a single set of attachment areas 804 may be used, wherein speakers 704 and 708 may be positioned in one respective pair of locations. Alternatively, a plurality of attachment areas may be used, wherein speakers 704 and 708 in addition to other speakers may be positioned thereby minimizing the front-to-back reversals for different users.

Figure 9:
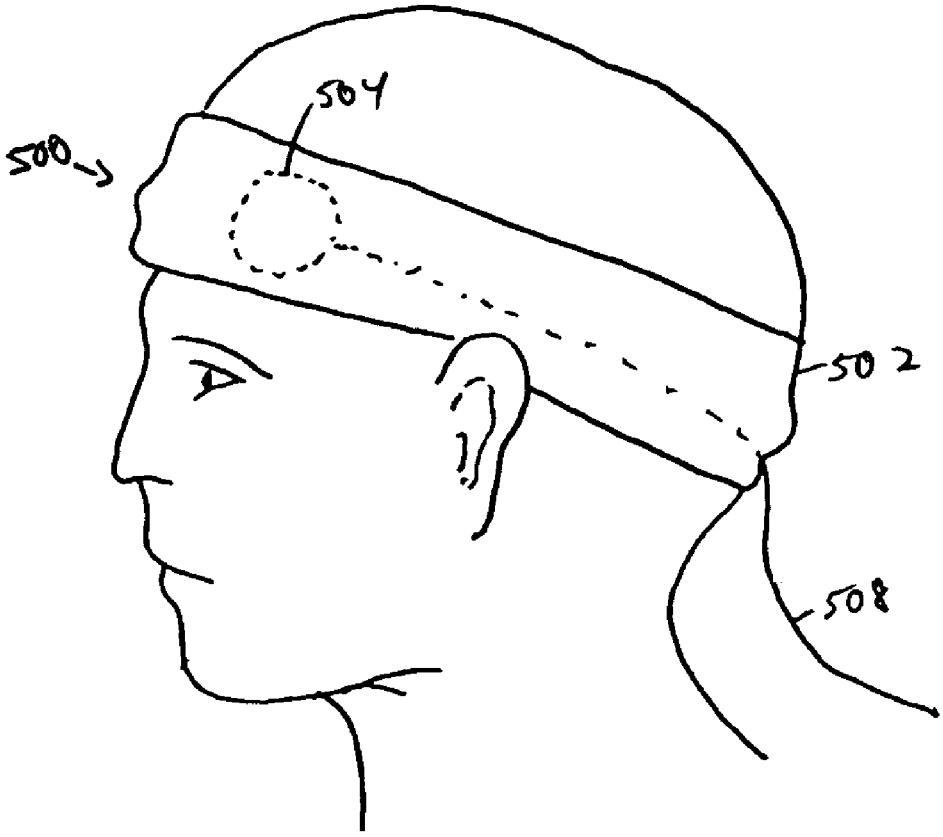
FIG. 9 illustrates another embodiment of a headpiece in accordance with the present invention.

FIG. 9 illustrates another embodiment of a headpiece in accordance with the present invention, wherein the headband 502 of FIG. 5 has been reversed such that speakers 504 and 506 are disposed against the head of the user. In the reversed position, speakers 504 and 506 generate acoustic signals that are conducted to the auditor senses through bone conduction in the skull, which is a quieter method of delivering the audio signals to the listener.

While specific positions for various components comprising the invention are given above, it should be understood that those are only indicative of the relative positions most likely needed to achieve a desired sound effect with reduced noise margins. It will be appreciated that the indicated components are exemplary, and several other components may be added or subtracted while not deviating from the spirit and scope of the invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus to be used by a person, said apparatus comprising:

a signal portion operable to provide audio signals corresponding to a sound to be reproduced and a virtual location of a source of the sound to be reproduced;

a headpiece to be worn by the person;

a tracking system operable to provide tracking signals corresponding to an orientation and location of the head of the person;

a head related transfer function (HRTF) filter; and a plurality of speakers disposed with said headpiece, wherein said HRTF filter is operable to spatially filter the audio signals, based on the tracking signals, and thereby provide spatially filtered audio signals, wherein said speakers are operable to reproduce the sound based on the spatially filtered audio signals such that the person hears the sound and perceives a maintained virtual location of the source of the sound, and wherein said speakers are disposed with said headpiece at respective positions that augment the sound reproduced by said speakers such that perceived front-to-back reversals in the maintained virtual location of the source of the sound are reduced.

2. The apparatus of claim 1, wherein said signal portion is operable to provide the audio signals as binaural audio signals.

3. An apparatus to be used by a person, said apparatus comprising:

a signal means for providing audio signals corresponding to a sound to be reproduced and a virtual location of a source of the sound to be reproduced;

a headpiece to be worn by the person;

a tracking means for providing tracking signals corresponding to an orientation and location of the head of the person;

a head related transfer function (HRTF) filter; and a plurality of speakers disposed with said headpiece, wherein said HRTF filter is operable to spatially filter the audio signals, based on the tracking signals, and thereby provide spatially filtered audio signals, wherein said speakers are operable to reproduce the sound based on the spatially filtered audio signals such that the person hears the sound and perceives a maintained virtual location of the source of the sound, and wherein said speakers are disposed with said headpiece at respective positions that augment the sound reproduced by said speakers such that perceived front-to-back reversals in the maintained virtual location of the source of the sound are reduced.

4. An apparatus to be worn by a person and for use with a system operable to produce spatialized audio signals, the system including a signal portion operable to provide audio signals corresponding to a sound to be reproduced and a virtual location of a source of the sound to be reproduced, a tracking system operable to provide tracking signals corresponding to an orientation and location of the head of the person, a head related transfer function (HRTF) filter operable to spatially filter the audio signals, based on the tracking signals, and thereby provide spatially filtered audio signals, said apparatus comprising:

a headpiece to be worn by the person;

an input portion operable to receive the spatially filtered audio signals; and a plurality of speakers disposed with said headpiece and operable to receive the spatially filtered audio signals from said input portion, wherein said speakers are operable to reproduce the sound based on the received spatially filtered audio signals such that the person hears the sound and perceives a maintained virtual location of the source of the sound, and wherein said speakers are disposed with said headpiece at respective positions that augment the sound reproduced by said speakers such that perceived front-to-back reversals in the maintained virtual location of the source of the sound are reduced.

5. The apparatus of claim 4, wherein said headpiece comprises a headband.

6. The apparatus of claim 5, wherein said plurality of speakers is disposed within said headband.

7. The apparatus of claim 5, wherein said plurality of speakers is disposed on said headband.

8. The apparatus of claim 4, wherein said headpiece further comprises a first connecting portion, wherein said plurality of speakers comprises a second connecting portion, and wherein said first connecting portion is operable to connect to said second connecting portion thereby to dispose said plurality of speakers on said headpiece.

9. The apparatus of claim 8, wherein said first connecting portion comprises a first plurality of individual connecting portions, wherein said second connecting portion comprises a second plurality of individual connecting portions, and wherein each of said second plurality of individual connecting portions is operable to connect to respective individual connecting portions of said first plurality of individual connecting portions.

* * * * *